US008053380B2

(12) United States Patent
Campbell et al.

(10) Patent No.: US 8,053,380 B2
(45) Date of Patent: Nov. 8, 2011

(54) EXTENSIBLE SPUNBONDED NON-WOVEN FABRICS

(75) Inventors: Richard A. Campbell, Cranberry Township, PA (US); Thomas A. Debowski, Monongahela, PA (US)

(73) Assignee: Braskem America, Inc., Philadelphia, PA (US)

( * ) Notice: Subject to any disclaimer, the term of this patent is extended or adjusted under 35 U.S.C. 154(b) by 229 days.

(21) Appl. No.: 12/484,642

(22) Filed: Jun. 15, 2009

(65) Prior Publication Data

US 2009/0311938 A1 Dec. 17, 2009

Related U.S. Application Data

(60) Provisional application No. 61/132,145, filed on Jun. 16, 2008.

(51) Int. Cl.
*D04H 3/16* (2006.01)

(52) U.S. Cl. ..... 442/401; 442/361; 264/175

(58) Field of Classification Search ..... 442/361, 442/401

See application file for complete search history.

(56) References Cited

U.S. PATENT DOCUMENTS

| | | | | |
|---|---|---|---|---|
| 5,011,891 | A | 4/1991 | Spenadel et al. | |
| 6,992,146 | B2 | 1/2006 | McLoughlin et al. | |
| 2005/0075458 | A1 | 4/2005 | Salek et al. | |
| 2005/0165173 | A1 * | 7/2005 | Autran et al. | 525/333.7 |
| 2006/0172647 | A1 | 8/2006 | Mehta et al. | |
| 2006/0247332 | A1 | 11/2006 | Coffey et al. | |

OTHER PUBLICATIONS

ISA/US, International Search Report for PCT/US2009/047377, Issued Jul. 27, 2009, Alexandria, VA.

* cited by examiner

*Primary Examiner* — Lynda Salvatore
(74) *Attorney, Agent, or Firm* — Duane Morris LLP

(57) ABSTRACT

Impact copolymers, comprising an in-reactor blend of homopolymer polypropylene and an ethylene-propylene rubber, can be processed into spunbond non-woven fabrics. These fabrics have been shown to have increased ultimate extension without reduction in the ultimate tensile strength, as compared to conventional homopolymer polypropylene derived spunbond non-wovens.

4 Claims, 2 Drawing Sheets

EXTENSIBLE SPUNBONDED NON-WOVEN FABRICS

CROSS-REFERENCE TO RELATED APPLICATION

This application claims priority to U.S. provisional application No. 61/132,145, filed Jun. 16, 2008.

BACKGROUND OF THE INVENTION

Spunbond fabrics produced with homopolymer polypropylene ("HPP") are well known in the industry. These fabrics though, possess certain qualities that are not ideal. Specifically, spunbond non-woven fabrics comprising HPP are subject to certain processing limitations that affect the ways in which these fabrics may be handled when producing a finished product.

Typical tactics used to modify the physical characteristics of a given HPP spunbond non-woven to make it more workable for a given application include increasing or decreasing a variety of parameters, alone or in various combinations. Parameters that may be modified include calender bonding temperature, calender pressure, calender bonding area, fiber diameter, and the weight of the fabric per unit area (basis weight). Even, however, when each of the above described properties is optimized for a given application, the HPP spunbond non-woven is still subject to certain inherent limitations that cannot be overcome, optimization notwithstanding.

Two of the most difficult issues to address with HPP spunbond non-woven fabrics are the limited fabric extension at the ultimate tensile strength and the nature of the fabric extension under load.

In view of these deficiencies, there is a need for novel spunbond non-woven products exhibiting improved force-extension relationships as compared to those of standard HPP spun bond non-woven fabrics.

SUMMARY OF THE INVENTION

The present invention is directed to spunbond non-woven fabrics possessing improved properties. The spunbond non-woven fabrics of the invention comprise a Ziegler-Natta produced impact copolymer. Preferably, the impact copolymer is an in-reactor blend of homopolymer polypropylene and an ethylene-propylene rubber ("EPR"). In other embodiments, though, the impact copolymer is a melt blend such that homopolymer polypropylene is blended with an EPR wherein each polymer was produced independently prior to blending.

DETAILED DESCRIPTION OF THE INVENTION

Figure 1:
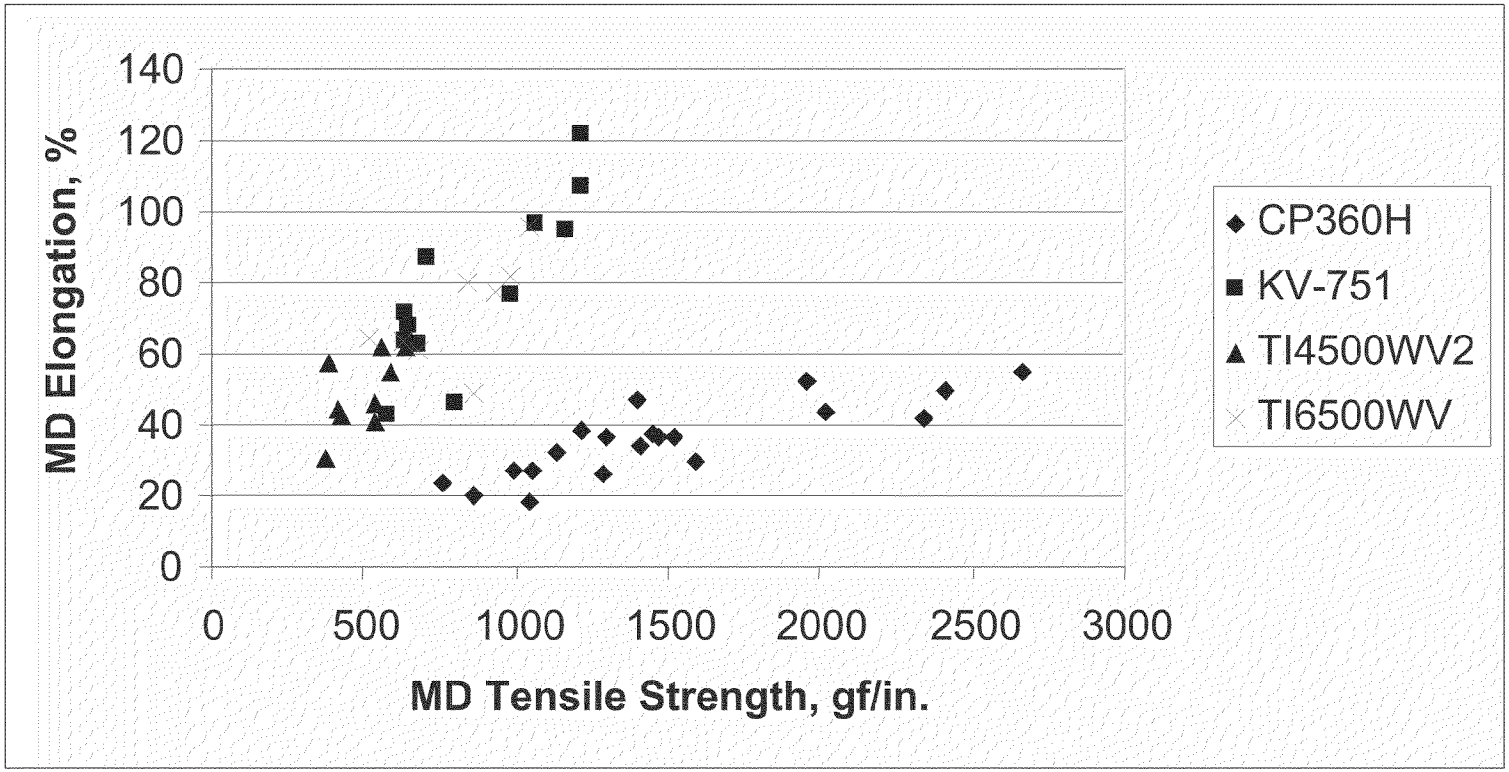
FIG. 1 is a scatter plot of the MD tensile strength vs. MD elongation for spunbond non-woven fabrics comprising impact copolymers KV-751, TI4500WV2, TI6500WV, and homopolymer polypropylene derived spunbond non-woven fabric CP360H.

The present invention is directed to a spunbond non-woven fabric comprising an impact copolymer. The impact copolymer comprising the fabric of the invention includes a homopolymer phase and an ethylene-propylene rubber ("EPR") phase. Without wishing to be bound to any particular theory, it is believed that the presence of the ethylene-propylene rubber phase provides the enhanced force-extension relationship in the invention fabric.

In order to obtain the improved properties described herein, the impact copolymer comprising the invention fabric should have certain physical characteristics. Preferably, the impact copolymer is an in-reactor blend of homopolymer polypropylene and an ethylene-propylene rubber ("EPR"). In other embodiments, though, the impact copolymer may be a melt blend such that homopolymer polypropylene is blended with an EPR wherein each polymer was produced independently prior to blending.

In certain embodiments, the impact copolymer of the invention has a melt flow rate (MFR) of between about 10 and about 75 g/10 min. In other embodiments, the melt flow is between about 20 and about 55 g/10 min. In other embodiments, the melt flow is between about 25 and 45 g/10 min. In a preferred embodiment, the melt flow of the impact copolymer is about 35 g/10 min.

The MFR of the impact copolymer comprising the spunbond non-woven fabric of the invention may be controlled through the addition or removal of hydrogen from a polymerization process producing the impact copolymer. Alternatively, or in conjunction with hydrogen MFR control, the desired MFR may be achieved through controlled rheology (visbreaking) via the addition of an appropriate amount of a suitable peroxide.

In some embodiments, the impact copolymer of the invention has a total ethylene content of about 10% to about 20% ethylene by weight. In other embodiments, the overall ethylene content of the impact copolymer is about 12% to about 18% ethylene by weight. In yet another embodiment, the overall ethylene content is about 14% to about 16%. In another embodiment, the overall ethylene content is about 15% ethylene by weight.

In some embodiments of the invention, the EPR phase of the impact copolymer comprising the fabric of the invention contains from about 40% to about 60% ethylene by weight. In other embodiments, the EPR phase contains about 45% to about 55% ethylene by weight. In another embodiment, the EPR phase contains about 50% ethylene by weight.

The impact copolymer comprising the non-woven fabric of the invention may comprise one or more additives. For both in-reactor produced impact copolymer and melt blended copolymer, the one or more additives are typically incorporated into the copolymer in a compounding step which is followed by extrusion and pelletizing.

Examples of common additives include clarifiers, nucleators, acid scavengers (or neutralizers), antioxidants, slip or mold release agents, anti-static agents, antiblock agents, anti-fogging agents, pigments, and peroxide. It is within the ability of the ordinarily skilled artisan to determine the appropriate amount as well as type or types of additive to be added to the impact copolymer comprising the invention fabric.

According to the process of the invention, the calender pressure for preparing the novel spunbond non-woven fabric may range from about 1250 psi to about 2250 psi, more preferably from about 1500 psi to about 2000 psi. The calender bonding area is typically fixed between about 14.4% and about 14.8% bonded area. Calender bonding temperature ranges from about 150° C. to about 165° C.

Fabrics of the invention comprising the impact copolymer described herein exhibited fiber diameters of about 3.5 denier per filament (dpf). Filament diameter may, however, range from about 0.5 to about 10 dpf.

General Spunbonding Procedure:

Polymer samples were added to a dosing station on top of an extruder attached to a spunbonding machine. Polymer from the dosing station was then fed into the extruder where it was melted and homogenized. After passing through a filter system, the melt was distributed by a coathanger die to a spinneret which formed a curtain of filaments. The filaments were then air cooled and discharged. Upon discharge, the filaments were randomly deposited on a wire mesh belt, forming a non-woven fabric. The non-woven fabric was then transferred to a heat bonding calender. After calendering, the material was cooled on one or more chill rollers and wound for later use.

EXAMPLES

Three commercially available impact copolymers from Sunoco, Inc. (KV-751, TI4500WV2, and TI6500WV) were processed into spunbond non-woven fabrics on a Reicofil spunbond line, according to the general procedure described above, using a 2,734-hole, 0.6 mm capillary diameter die. The throughput for each polymer was maintained at 107 kg/hr/m. The resulting spunbond non-woven fabrics were maintained at basis weights of 15 grams per square meter (gsm), 18 gsm, or 25 gsm. A fourth sample, compounded from TI5150M-type powder, also from Sunoco, was likewise prepared into a spunbond non-woven and tested.

Fabric samples obtained from the commercial polymers were tested according to ASTM D5035 for tensile strength and elongation in the machine direction (MD) and cross-machine direction. The cross-machine direction may be referred to as the "transverse direction" or "TD." The machine direction is defined as the direction the forming belt on which the sunbonded fiber mat is deposited travels. The transverse direction is orthogonal to the machine direction.

The properties of the resulting fabrics were compared to those of an equivalent (by basis weight) fabric produced from Sunoco CP360H HPP, a resin commonly employed for the production of spunbond non-woven fabrics. Unexpectedly, the fabrics comprising an impact copolymer showed enhanced capabilities relative to spunbond non-woven fabrics comprising HPP.

Specifically, the fabrics of the invention were able to match the ultimate elongation of the HPP spunbond non-woven, but at a lower relative tensile strength. Similarly, the fabric of the invention was able to exceed the ultimate elongation of an equivalent HPP spunbond non-woven fabric at the HPP spunbond non-woven fabric's ultimate tensile strength. See, for example, FIG. 1 which plots MD tensile strength vs. MD elongation for the invention spunbond non-woven fabrics as well as standard HPP spunbond non-woven fabric.

Figure 2:
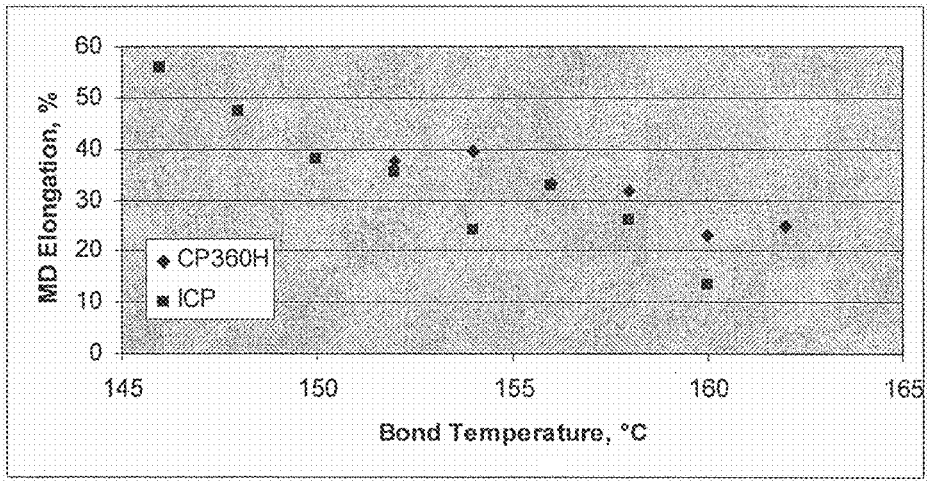
FIG. 2 is a scatter plot of Calendar Bonding Temperature vs. MD Elongation for spunbond non-woven fabrics comprising impact copolymer KV-751 and homopolymer polypropylene CP360H.

The fabric of the present invention also provides superior or equivalent performance in terms of MD enlongation, as compared to an HPP derived spunbond nonwoven, at a given calender bonding temperature. See, for example, FIG. 2.

What is claimed is:

1. A spunbond non-woven fabric comprising a Ziegler-Natta produced polypropylene impact copolymer, said impact copolymer comprising a homopolymer polypropylene phase and an ethylene-propylene rubber phase, wherein:

said impact copolymer has a melt flow of about 20 to about 70 g/10 min;

the ethylene content of said ethylene-propylene rubber is about 40% to about 60% by weight;

the ethylene content of said impact copolymer is about 10% to about 20% by weight; and said fabric, at about 800 gf/in has an MD elongation of about 30% to about 40%.

2. The spunbond non-woven fabric of claim 1 wherein said impact copolymer has a melt flow of about 35 g/10 min.

3. The spunbond non-woven fabric of claim 1 wherein said impact copolymer has a melt flow of about 50 g/10 min.

4. A method for preparing a spunbond non-woven fabric comprising a Ziegler-Natta produced polypropylene impact copolymer, said impact copolymer comprising a homopolymer polypropylene phase and an ethylene-propylene rubber phase, wherein:

said impact copolymer has a melt flow of about 20 to about 70 g/10 min;

the ethylene content of said ethylene-propylene rubber is about 40% to about 60% by weight;

the ethylene content of said impact copolymer is about 10% to about 20% by weight; and said fabric, at about 800 gf/in has an MD elongation of about 30% to about 40%.

* * * * *